US008819945B2

(12) United States Patent
Reibold

(10) Patent No.: US 8,819,945 B2
(45) Date of Patent: Sep. 2, 2014

(54) UTILITY KNIFE WITH DETACHABLE GUARD

(76) Inventor: Robert Reibold, York, PA (US)

( * ) Notice: Subject to any disclaimer, the term of this patent is extended or adjusted under 35 U.S.C. 154(b) by 206 days.

(21) Appl. No.: 13/358,747

(22) Filed: Jan. 26, 2012

(65) Prior Publication Data

US 2013/0192069 A1 Aug. 1, 2013

(51) Int. Cl.
*B26B 29/02* (2006.01)
*B26B 1/10* (2006.01)

(52) U.S. Cl.
USPC ..... 30/295; 30/2; 30/286; 30/289; 30/293; 30/294

(58) Field of Classification Search
USPC ..... 30/2, 151–154, 162–164, 286, 295, 30/320, 123, 289, 293, 294
See application file for complete search history.

(56) References Cited

U.S. PATENT DOCUMENTS

| | | | | |
|---|---|---|---|---|
| 1,754,543 | A | 4/1930 | Callum | |
| 2,095,164 | A | 10/1937 | Babb | |
| 2,120,960 | A | 6/1938 | Arthur | |
| 2,329,805 | A * | 9/1943 | Wilson, Sr. | 30/90.4 |
| 3,178,812 | A | 4/1965 | Lurie | |
| 4,961,523 | A * | 10/1990 | Stimac | 224/232 |
| 4,987,682 | A | 1/1991 | Minnick | |
| 5,490,331 | A | 2/1996 | Gold | |
| 5,495,670 | A | 3/1996 | Quinn | |
| D374,597 | S | 10/1996 | Birkholz et al. | |
| 5,568,689 | A | 10/1996 | Gold | |
| 5,581,893 | A | 12/1996 | Ouellette | |
| D379,056 | S | 5/1997 | Gold | |
| 5,794,350 | A | 8/1998 | Shand | |
| 5,943,780 | A * | 8/1999 | McIlhatten | 30/294 |
| 6,148,522 | A | 11/2000 | Dobandi | |
| 6,321,454 | B1 | 11/2001 | Wass | |
| 6,412,382 | B1 | 7/2002 | Conley | |
| 6,532,670 | B1 | 3/2003 | Berns | |
| D474,390 | S | 5/2003 | Wass | |
| 6,964,100 | B1 * | 11/2005 | Musland | 30/286 |
| 7,194,809 | B2 | 3/2007 | Skluzak | |
| 2012/0124843 | A1 | 5/2012 | Reibold | |

OTHER PUBLICATIONS

Web page http://www.chhanson.com/knivesAndBlades.html.

* cited by examiner

*Primary Examiner* — Clark F. Dexter
(74) *Attorney, Agent, or Firm* — Howson & Howson LLP

(57) ABSTRACT

In a utility knife, having a handle, a blade, and a guard that prevents the user's fingers from being lacerated or abraded, a flexible strap with a stud that snap-fits into a socket in the guard is used to secure the guard to the handle. The stud fits into a recess in the handle to limit or prevent longitudinal movement of the guard relative to the knife handle.

4 Claims, 10 Drawing Sheets

UTILITY KNIFE WITH DETACHABLE GUARD

FIELD OF THE INVENTION

This invention relates to utility knives, and more particularly to a utility knife having capabilities advantageous to roofers, builders, electricians, flooring installers, and other individuals who make extensive use of such knives.

BACKGROUND OF THE INVENTION

A conventional utility knife comprises an elongated handle shaped to fit comfortably in an individual's hand, and a blade fixed to, and extending from one end of, the handle. A typical utility knife blade has a trapezoidal shape, with its cutting edge extending along the longer base of the trapezoid. The blade is usually replaceable, and when installed in the handle, extends therefrom in such a way that the shorter base of the trapezoid is fully or almost fully enclosed within the handle. Consequently, the exposed part of the blade is generally in the form of a trapezoid or a triangle.

Ordinarily, the handle consists of two similar parts that meet each other in a plane along which the blade extends. The parts are held together by one or more machine screws. One or more protrusions within one of the handle parts cooperate with notches in the shorter base of the trapezoidal blade to secure the blade against longitudinal movement relative to the handle when the handle parts are fitted together. The handle is also usually hollow, and the space inside the handle can be used to store spare blades.

The conventional utility knife handle has a tapered transition from the part that is grasped to the end from which the blade extends. A roofer who works with asphalt shingles typically makes extensive use of a utility knife to cut shingles, roofing paper, rubber waterproofing sheets, and other sheet roofing material. Slipping of the hand along the knife handle in the direction of the blade due to fatigue, moisture, inattention and other factors can result in laceration by the cutting edge of the blade or abrasion by contact with the hard granules embedded in an asphalt shingle. Other workers who use utility knives are subject to similar injuries.

Roofers, and other workers who use utility knives, frequently have occasion to cut a surface only to a limited depth, shorter than the distance by which the cutting edge of a typical utility knife blade protrudes from the knife handle. For example, gypsum roofing board used for fire protection, such as "DENSDECK DURAGUARD" roofing board, is cut to size by scoring along a straight line and then snapping the parts on both sides of the score line apart. To score such materials properly with a utility knife, the cutting depth of the knife blade should be relatively small, and in any event less than the thickness of the material.

Although some utility knives having retractable blades can be adjusted to set the cutting depth, a conventional knife in which the trapezoidal blade is secured against longitudinal movement by the engagement of protrusions within the handle with notches along its short base has no capability of rapid cutting depth adjustment. The handle parts must be separated. Then, after the blade-holding protrusion or protrusions are engaged with other notches in the blade, the handle parts must be reassembled. The knife is limited to a relatively small number of discrete cutting depths, corresponding to a whole number equal to or less than the number of notches in the short base of the trapezoidal knife blade.

It is also important, especially in roofing applications, to be able to cut shingles from the top by gripping a utility knife in such a way that the cutting edge faces in a direction away from the wrist, and also to cut other roofing materials such as rubber sheets from the underside by a pulling action in which the knife is gripped in such a way that the cutting edge faces in a direction toward the wrist. In the first of these instances, the knife handle is held in an oblique relationship to the work. In the second, the knife handle is generally perpendicular to the work. There is a risk of injury when operating a conventional utility knife in each of these two modes.

SUMMARY OF THE INVENTION

This invention has potential to reduce the incidence of laceration, abrasion and similar injuries commonly sustained in the use of utility knives. Some embodiments of the invention can also provide for rapid adjustment of the length of the exposed cutting edge. In addition, some embodiments of the invention can provide for protection of the user in both of the above-mentioned oblique and perpendicular cutting modes, while providing for proper blade guidance and control of cutting depth in each mode.

The utility knife in accordance with a first aspect of the invention comprises an elongated handle having opposite sides extending along the direction of elongation, and opposite ends spaced from each other along the direction of elongation. A blade is fixed to, and protrudes from, the handle at one of the opposite ends of the handle. The handle is provided with a guard comprising a pair of laterally protruding guard members positioned adjacent the end of the handle from which the blade protrudes. The guard members protrude respectively from the opposite sides of the handle by a distance sufficient to prevent a user's hand from sliding past the end of the handle from which the blade protrudes.

In certain preferred embodiments of the invention, the guard is detachably connected to the handle and comprises a pair of side members spaced from each other and respectively in abutting relationship with opposite sides of the handle. The side members are rigidly connected to each other by a work-engaging member having a slot through which the blade extends. A fastener extends through a through hole in at least one of the side members and connects that side member to the handle. Where the handle comprises two separable elongated parts, the handle parts can be held together by the same fastener that connects the side member of the guard to the handle.

The through hole can be an elongated through hole extending in a direction parallel to the blade, whereby, by loosening the fastener, the position of the work-engaging member relative to the handle can be adjusted. If the elongated through hole extends substantially parallel to the direction of elongation of the handle, by loosening the fastener, the position of the guard can be adjusted longitudinally for adjustment of the extent to which the blade is exposed beyond the work-engaging member. On the other hand, if the through hole extends in a direction transverse to the direction of elongation of the handle, by loosening the fastener, the angular relationship of the work-engaging member and the direction of elongation of the handle can be adjusted.

In still another embodiment, at least two through holes are provided in one of the side members. The through holes are spaced from one another, and the fastener can be alternatively extended through one or another of the through holes for adjustment of the position of the work-engaging member relative to the handle.

In still another embodiment, the work-engaging member is formed with two narrow ends, both aligned with the blade, and in which the blade extends through the slot in the work-engaging member between those narrow ends. In this embodiment, the narrow ends provide for improved visual guidance, enabling the user to follow a guide line drawn on a workpiece more accurately.

In a modified embodiment, The work-engaging member is a concave U-shaped member adapted to receive an insulated cable. In still another modified embodiment, the work-engaging member can be a convex member having work-engaging surfaces on both sides of the slot, the work engaging surfaces both diverging from each other and being disposed at an angle of 135 degrees relative to the protruding part of the blade.

In another embodiment, the utility knife can have a detachable guard member with or without a work-engaging part, but with laterally protruding parts that prevent a user's hand from sliding past the end of the handle from which the blade protrudes. In this case, the utility knife comprises an elongated handle having opposite sides extending along the direction of elongation, and opposite ends spaced from each other along the direction of elongation. A blade is fixed to, and protrudes from, the handle at one of the opposite ends of the handle. A guard detachably connected to the handle, comprises a pair of side members which are spaced from each other and respectively in abutting relationship with opposite sides of the handle, the side members are rigidly connected to each other and each side member has a laterally protruding guard positioned adjacent the end of the handle from which the blade protrudes by a distance sufficient to prevent a user's hand from sliding past the end of the handle from which the blade protrudes. At least one of the side members has a through hole. A fastener extends through the through hole and connects the side member to the handle.

In still another embodiment, a detachable guard is designed so that it can be easily, quickly, and securely attached to a conventional utility knife. In this embodiment, the guard is configured to receive the end of the utility knife body from which the blade protrudes, and is provided with a flexible strap that extends over the top of the knife body, and has a stud that snaps into a socket in the guard and extends through the socket into a recess in the wall of the utility knife to secure the guard against longitudinal movement relative to the knife body.

Further embodiments, and other details and advantages of the invention will be apparent from the following description when read in conjunction with the drawings.

BRIEF DESCRIPTION OF THE DRAWINGS

FIG. 11 is an oblique perspective view of a linearly adjustable guide, in accordance with a fifth embodiment of the invention, for use with a utility knife in order to strip insulation from an electrical cable or the like;

DETAILED DESCRIPTION OF THE PREFERRED EMBODIMENTS

Figure 1:
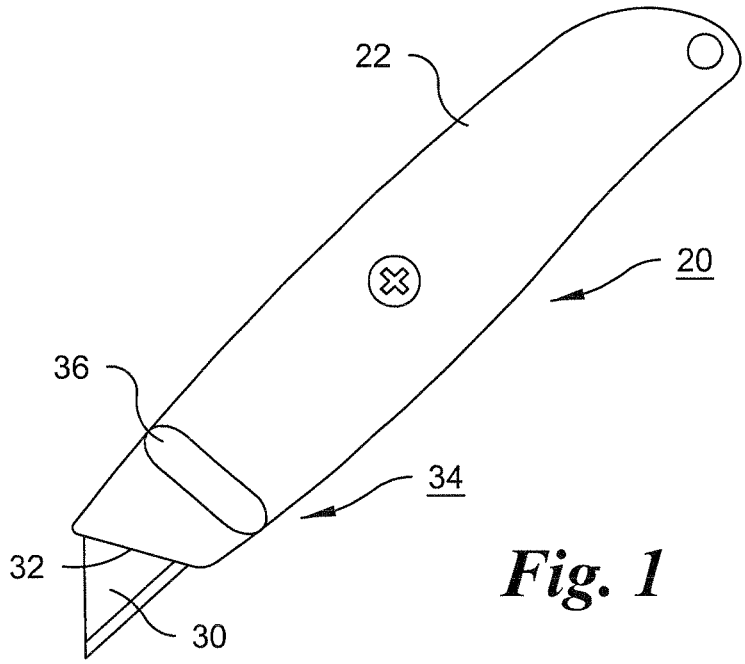
FIG. 1 is a side elevational view of a utility knife according to a first embodiment of the invention.
Figure 2:
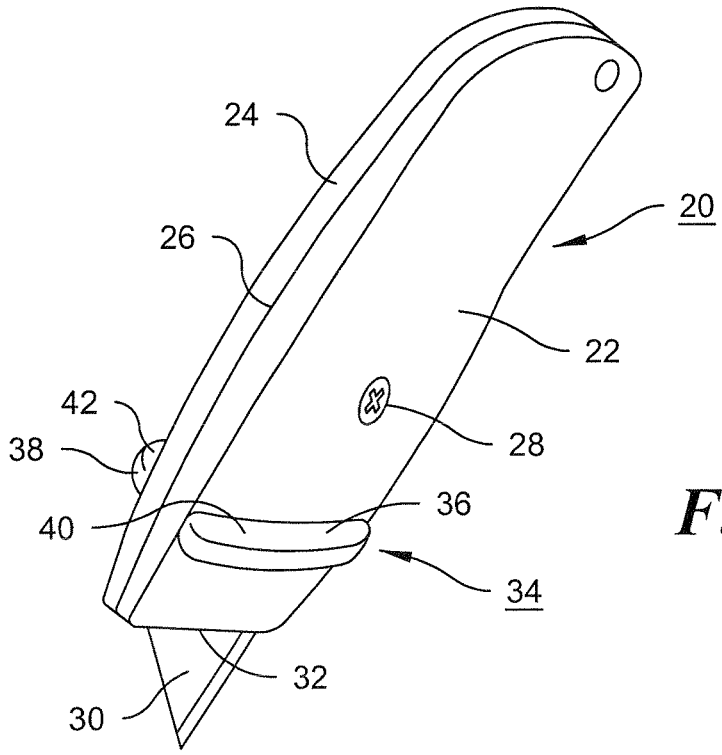
FIG. 2 is an oblique perspective view of the utility knife of FIG. 1.

A knife 20 shown in FIGS. 1 and 2 is in most respects similar to a conventional utility knife, the knife handle being composed of two similar handle parts 22 and 24, which meet each other in a plane 26 with respect to which the two handle parts are substantially symmetrical. Handle parts 22 and 24 are secured together by a machine screw 28, which can be readily removed by means of a screwdriver, allowing the two parts to be separated from each other.

When held together by screw 28, handle parts 22 and 24 clamp a trapezoidal blade 30 in such a way that a part of the blade is exposed, protruding from a distal end 32 of the handle while the remainder of the blade is hidden inside the handle between the handle parts 22 and 24. As explained previously a conventional utility knife handle is typically hollow so that a space is provided for storage of spare blades, and one or both of the handle parts includes protrusions that fit into notches formed in an edge of the blade opposite from the cutting edge to secure the blade against longitudinal movement relative to the handle when the blade is clamped between the handle parts 22 and 24. The knife of FIGS. 1 and 2 can be, and preferably is, constructed similarly.

The handle parts of a conventional utility knife are typically cast from steel, aluminum or another suitable metal or metal alloy, or molded from a suitable polymeric resin. The knife of FIGS. 1 and 2 differs from the conventional utility knife primarily in that protrusions are integrally formed with the handle parts 22 and 24, and together form a guard 34. Thus, a protrusion 36 is cast or molded as a unitary part of handle part 22, and protrusion 38 is cast or molded as a unitary part of handle part 24.

Each of the protrusions 36 and 38 is preferably generally crescent-shaped, with a rounded outer edge as seen in FIG. 2. The proximal surfaces 40 and 42 of the protrusions 36 and 38 are engageable by the user's hand, and prevent the hand from contacting the blade and the work, i.e., the material being cut. Although the distal end 32 of the handle is preferably oblique relative to the direction of the long dimension of the handle, the proximal surfaces 40 and 42 of the guard protrusions are preferably more nearly perpendicular to the direction of the long dimension of the handle, so that they not only prevent the thumb and forefinger of the user from sliding in the distal direction on the handle, but can also comfortably engage the little finger and the adjacent metacarpal region of the hand when the handle is held in a "stabbing" configuration.

Although, the proximal surfaces 40 and 42 can be flat, optionally, they can be formed with a slight concavity in order to fit the thumb and forefinger of the user.

Figure 3:
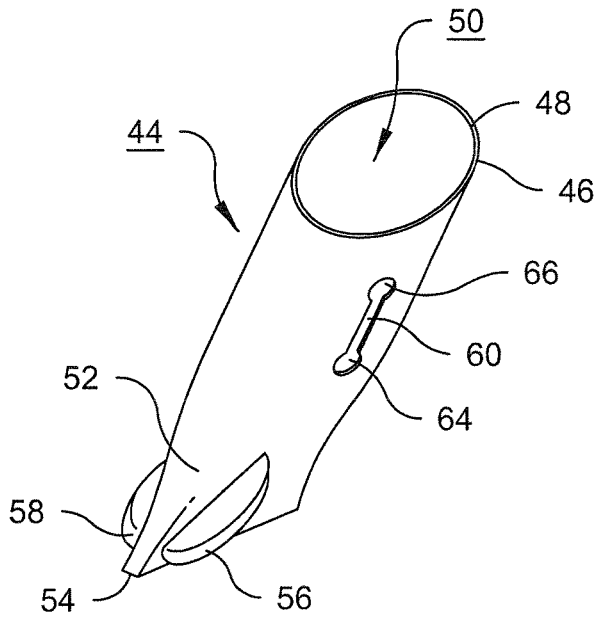
FIG. 3 is an oblique perspective view of a longitudinally adjustable guard in accordance with a second embodiment of the invention.
Figure 4:
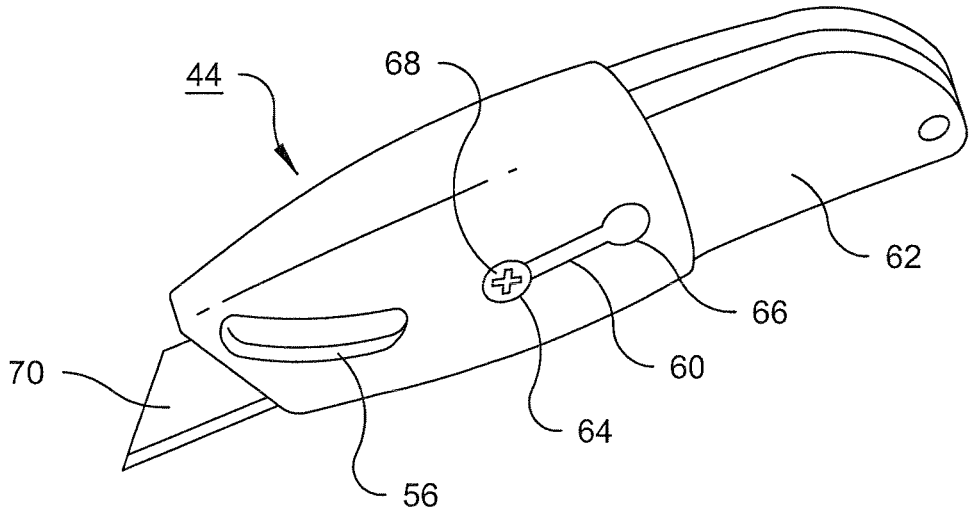
FIG. 4 is an oblique perspective view of a utility knife equipped with the adjustable guard of FIG. 3.

The benefits of the guard of the first embodiment can be realized by attachment of a retrofit guard unit to a conventional utility knife. Guard unit 44, shown in FIGS. 3 and 4, is an example of a retrofit guard unit. The guard unit 44 is formed with a tubular wall 46, and has an end opening 48 through which a conventional utility knife can be inserted into an interior space 50 shaped to conform to the distal portion of the knife. The guard unit is tapered at tapered portion 52, and the end 54 opposite from opening 48 is provided with a slot through which a blade of the utility knife can protrude. Guard protrusions 56 and 58 are provided on opposite sides of the tapered portion 52 of the guard unit. These guard protrusions can be configured so that their upper surfaces are inclined forward and away from the part of end 54 through which the cutting edge of the blade extends. In a number of applications of a utility knife, it is important for the cutting edge of the knife blade to exert a large force on the material being cut. If the guard protrusions 56 and 58 are configured, as shown, so that they extend along the sides of the guard unit at an small angle relative to the cutting edge of the blade, the user, by pressing a thumb and fingers against the surfaces of the guard protrusions, can exert a large force in a direction perpendicular to the cutting edge of the blade.

The wall 46 of the retrofit guard unit 44 is provided with a slot 60, elongated in the direction in which the knife 62 (FIG. 4) moves into space 50. The slot has enlarged circular openings 64 and 66 at its opposite ends. The screw 68, which holds the two halves of the knife handle together, extends through slot 60, and its head fits in enlarge circular opening 64 at the distal end of slot 60 securing the guard unit, in a position providing for a predetermined degree of protrusion of the blade 70 beyond the end 54 of the guard unit 44. The screw 68 is preferably a pan head or button head screw, having a circular, cylindrical outer surface that snugly fits either of the circular openings at the opposite ends of slot 60, thereby preventing longitudinal movement of the guard unit relative to the knife handle but at the same time allowing the two halves of the knife handle to be securely fastened together by tightening of the screw. Since the screw used in a conventional utility knife is typically a countersunk, flat-head screw, a replacement screw having a pan head or a button head may be used to replace the conventional flat-head screw. In the embodiment shown, the retrofit guard unit can be positioned as shown in FIG. 4, with the screw head in circular opening 64, or alternatively, with the screw head in circular opening 66. In the former case, the knife blade 70 extends beyond the end 54 of the guard to a maximum extent. In the latter case, only a small portion of the knife blade 70 extends beyond the end 54 of the guard. The latter position can be used in scoring material, and in other applications where a limited cutting depth is required.

In an alternative embodiment, not shown, the slot 60 can have one or more circular enlarged openings at intermediate positions between its end openings 64 and 66 to allow for additional discrete settings of the cutting depth.

In still another alternative, the slot can be formed as a simple elongated slot without circular enlargements. In this case the screw head, the diameter of which should be larger than the slot width, can be tightened against the outer surface of the guard wall on both sides of the slot and hold the two halves of the knife handle together while at the same time securing the guard in a desired position. In this case, the cutting depth is not limited to discrete depths, but is continuously adjustable though a range determined by the length of the slot.

As mentioned previously, a utility knife is most often held in such a way that the cutting edge faces in a direction away from the wrist. However, there are also occasions, for example the cutting of rubber sheets from the underside by a pulling action in which the knife is gripped so that the cutting edge faces toward the user's wrist. In the first of these instances, the knife handle is held in an oblique relationship to the work. In the second, where the knife handle is gripped in an entirely different manner, it is preferable to hold the knife handle generally perpendicular to the work. The embodiment depicted in FIGS. 5-7 satisfies these objectives by means of an angularly adjustable guard unit 68, which can be attached to a conventional utility knife 70.

Figure 5:
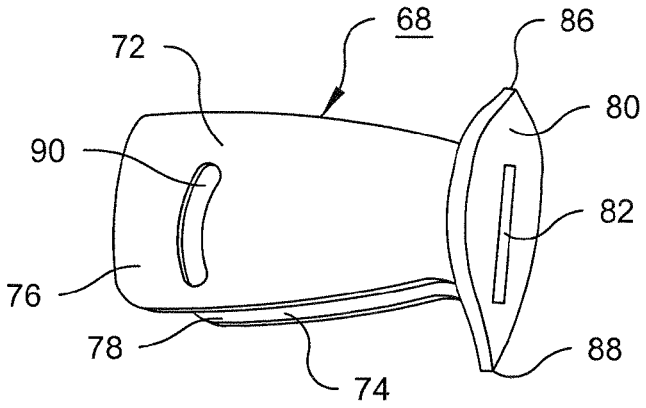
FIG. 5 is an oblique perspective view of an angularly adjustable combination guard and guide for a utility knife, in accordance with a third embodiment of the invention.
Figure 6:
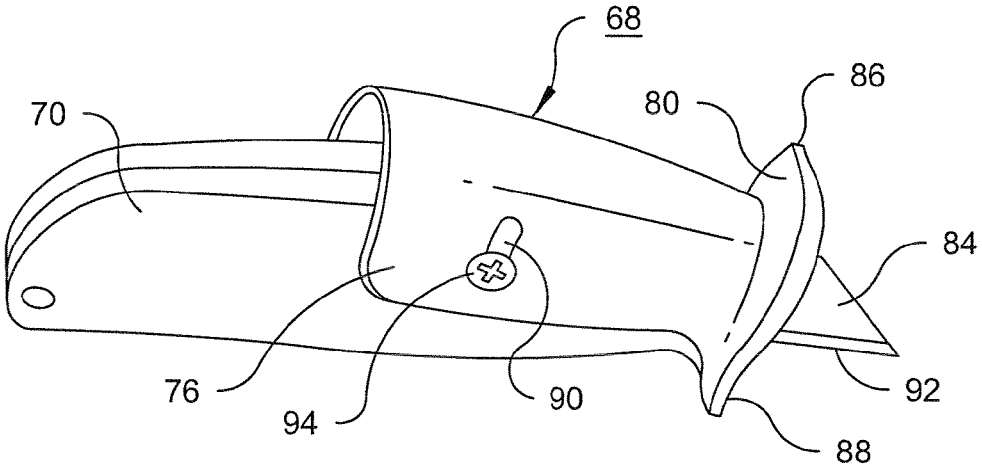
FIGS. 6 and 7 are oblique perspective views of a utility knife equipped with a combination guard and guide as shown in FIG. 5, respectively showing the combination guard and guide in two different angular positions.

As shown in FIG. 5, the guard unit comprises a U-shaped sleeve 72, having an opening 74 between parallel side parts 76 and 78. The width of the space between parts 76 and 78 corresponds to the width of the distal portion of the body of utility knife 70, so that the distal portion can be received between parts 76 and 78 as shown in FIGS. 6 and 7.

A plate 80 is provided at one end of the U-shaped sleeve 72, the plate being welded, or otherwise suitably attached, to sleeve 72. The plate 80 has a slot 82 through which the knife blade 84 can extend, and is shaped with a double taper so that guide points 86 and 88 are formed at both ends of the plate along an imaginary line aligned with the slot 82. Thus the guard unit can function as a combination guard and guide, preventing the user's hand from contacting the blade and the work, and also enables the user to follow a chalk line or other guide line drawn on the work.

An arcuate slot 90 is formed in part 76 of the U-shaped sleeve 72 at a location such that a screw that holds the two parts of the knife handle together can extend through the slot when the knife blade extends through the slot 82. The slot extends in a direction transverse to the direction of elongation of the knife handle. As shown in FIG. 6, the guard unit can be pivoted to a position in which the knife handle extends at an angle relative to the cutting edge 92 of the blade so that the work-engaging surface of the plate 80 is engaged in parallel relationship with the surface of the work while the handle is in an oblique relationship to the surface of the work. The guide is secured to the knife handle in the relationship shown in FIG. 6 by tightening the head of screw 94 against the outer surface of part 76 of the sleeve, and the knife can be used in the conventional fashion. The screw can, of course, be tightened at any desired intermediate position in slot 90.

Figure 7:
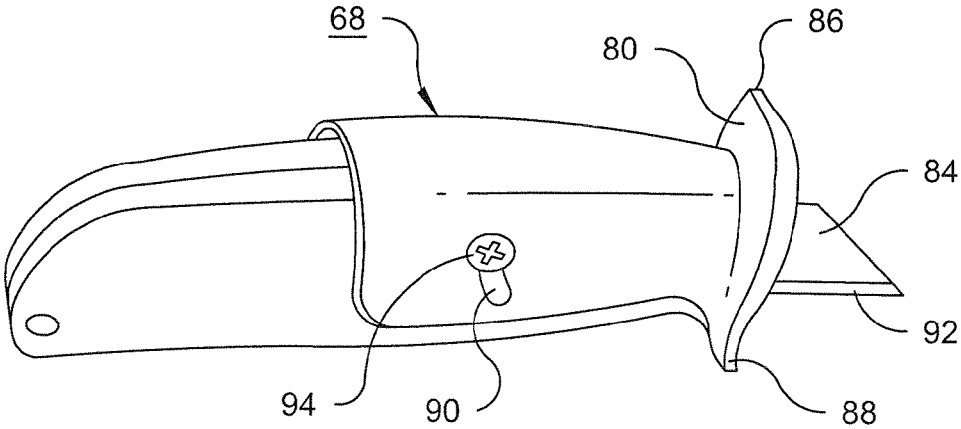

In the alternative configuration shown in FIG. 7, the guard unit is positioned so that the screw 94 is located at the opposite end of arcuate slot 90. With the guard unit in this position, the cutting edge 92 of the knife blade is generally parallel to the direction of elongation of the knife handle, and the handle can be more easily gripped with the cutting edge facing toward the user's wrist. With the knife handle gripped in this manner, the user can more easily cut workpieces such as rubber roofing sheets from underneath.

Figure 8:
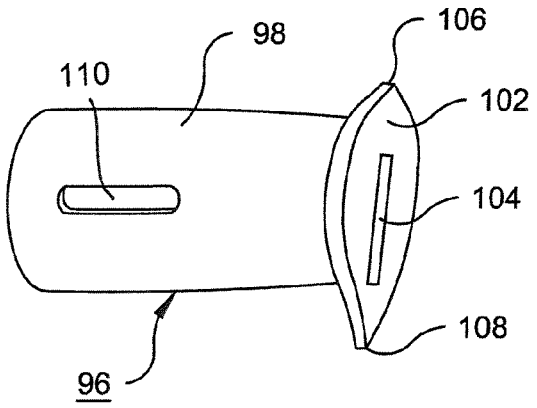
FIG. 8 is an oblique perspective view of a linearly adjustable combination guard and guide for a utility knife in accordance with a fourth embodiment of the invention.
Figure 9:
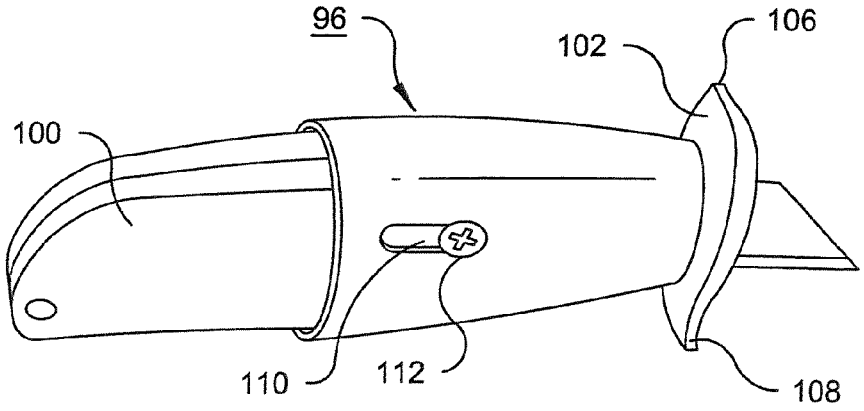
FIGS. 9 and 10 are oblique perspective views of a utility knife equipped with a combination guard and guide as shown in FIG. 8, respectively showing the combination guard and guide in two different linear positions relative to the body of the utility knife.
Figure 10:
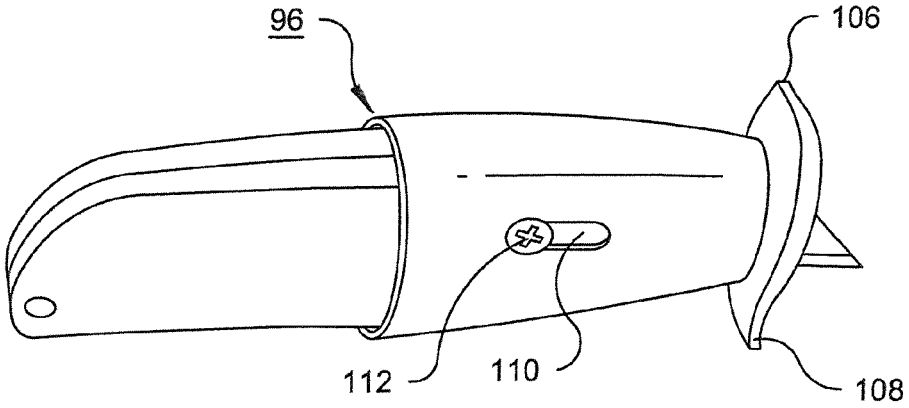

The guard unit 96, shown in FIGS. 8-10 is designed for longitudinal adjustment along the knife handle in order to regulate cutting depth. The guard unit 96 comprises a hollow tubular part 98, shaped to receive the distal part of the handle of knife 100 as shown in FIGS. 9 and 10.

A plate 102 is provided at one end of the tubular part 98, being connected thereto by welding or other suitable means. The plate has a slot 104 through which the knife blade can extend. The plate can be perpendicular to the direction of elongation of the knife handle, as shown in the drawings. Alternatively, the plate can be oblique to the direction of elongation of the knife handle. The plate is doubly tapered to form guide points 106 and 108 aligned with slot 104.

A slot 110 in tubular part 98 extends lengthwise in a direction parallel to the axis of the tubular part 98, and the guard unit is secured to the knife handle by tightening the head of screw 112 that holds the parts of the knife handle together against the outer surface of tubular part 98. The guard unit can be positioned with the screw located at one end of the slot as shown in FIG. 9 for a maximum cutting depth, or with the screw located at the opposite end of the slot for a minimum cutting depth. The screw can also be tightened at any intermediate position in the slot.

Figure 11:
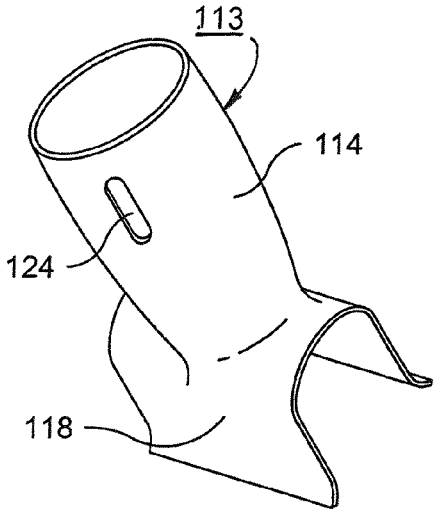
Figure 12:
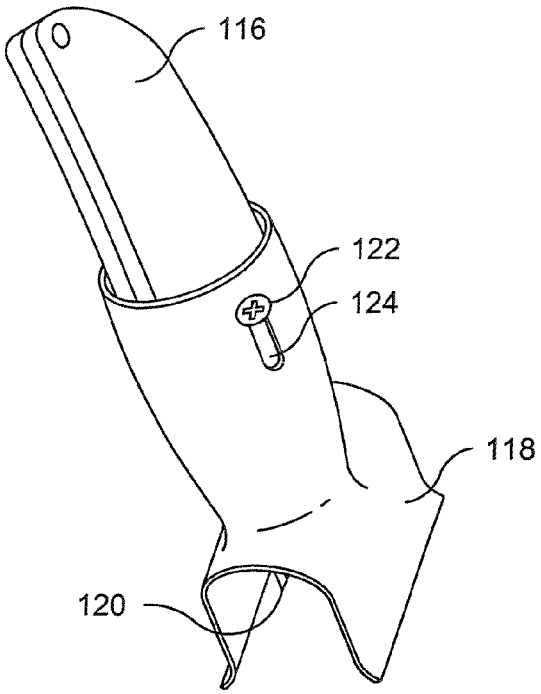
FIGS. 12 and 13 are oblique perspective views of a utility knife equipped with a guide as shown in FIG. 11, respectively showing the guide in two different linear positions relative to the body of the utility knife.
Figure 13:
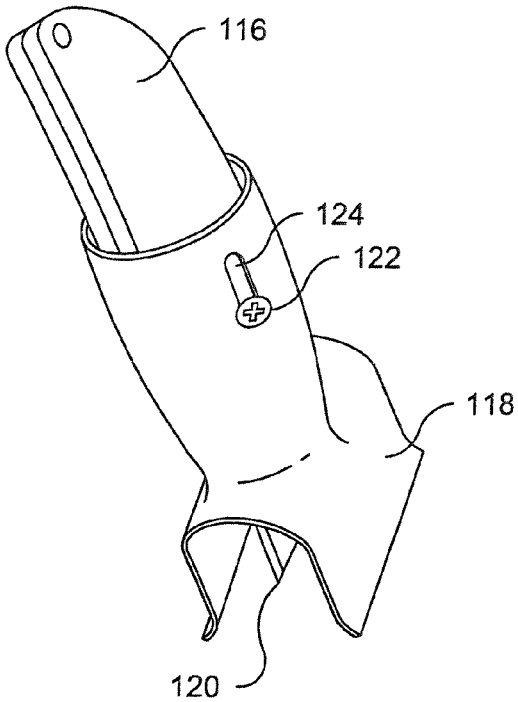
Figure 14:
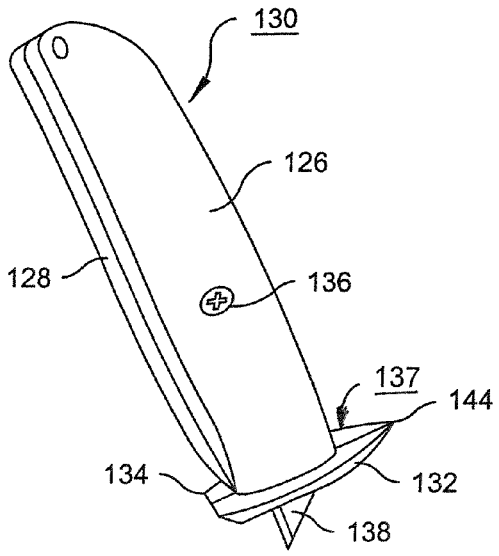
FIG. 14 is an oblique perspective view of a sixth embodiment of the invention which is a modification of the utility knife of FIGS. 1 and 2, in which the guard is configured for use in cutting flexible flooring material such as linoleum or PVC sheets.
Figure 15:
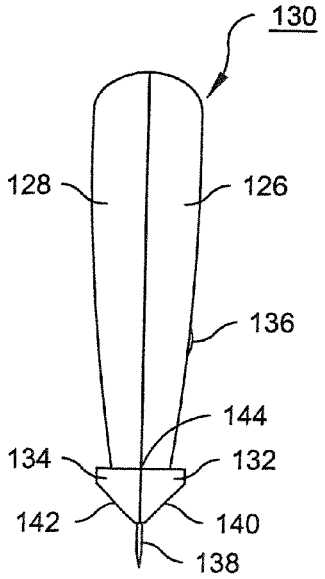
FIG. 15 is a front elevational view of the utility knife of FIG. 14.

The manner in which cutting depth is adjusted in the embodiment of FIGS. 8-10 can be applied to another embodiment in which the guard unit is designed for cutting the outer insulation of electrical cables such as heavy, single conductor, electrical cables, coaxial cables, and the like. As shown in FIG. 11, a guard unit 113 comprises a hollow tubular part 114, shaped to receive the distal part of the handle of knife 116 as shown in FIGS. 12 and 13. A flared, generally U-shaped guide 118 is formed at one end of the tubular part 114. The U-shaped guide is sized in accordance with the diameter of the cable, and, because of its U shape, maintains alignment of cutting blade 120 of the knife 116 with the axis of the cable during cutting.

A screw 122, which holds the two parts of the knife handle together, extends through a slot 124 in the wall of the tubular part of the guard unit. The cutting depth is adjusted by tightening the screw 122 against the outer surface of the tubular part 114.

In the embodiment of FIGS. 11-13, the U-shaped guide can be configured so that when the cable fits into the guide, the knife handle is perpendicular to the length of the cable. Alternatively, the guide can be configured so that the knife handle is in oblique relationship to the length of the cable.

The embodiment shown in FIGS. 14-17, can be used to cut flexible flooring material such as linoleum or PVC sheets or tiles at the location at which the flooring material meets a vertical wall or baseboard. Handle parts 126 and 128 are secured together to form a knife handle 130. Handle parts 126 is formed as a unit with a guard part 132 and handle part 128 is similarly formed as a unit with guard part 134. When the handle part 126 and 128 are secured together by screw 136, guard parts 132 and 134 come together to form a boat-shaped guide 137 having substantially flat surfaces 140 and 142, which diverge from a knife blade 138 that protrudes through a slot 143 (FIG. 17) located where the surfaces 140 and 142 come together. Surfaces 140 and 142 are perpendicular to each other, and each of them forms an angle of 135° with the blade. Accordingly, when the knife is used to cut flexible flooring sheets or tiles at the location at which the underlying floor meets a wall or baseboard, the knife can be disposed at a 45° angle relative to the wall and floor, with one of surfaces 140 and 142 in engagement with a horizontal part of a sheet or tile of flooring material and the other in engagement with a part of the sheet or tile bent upward against the wall.

The guard parts 132 and 134 form a boat-shaped structure that can be used to form a crease in flexible flooring material, such as linoleum flooring sheets, when the blade is removed from the knife (or withdrawn in the case of a knife having a retractable blade). The guard parts converge to a point 144, which can be used as a visual guide, enabling the worker to follow a line drawn on the flooring material while forming a crease in the material. Both when cutting and when forming a crease, the surfaces 140 and 142 aid the worker in maintaining the knife at a 45° angle relative to the floor and wall.

Figure 18:
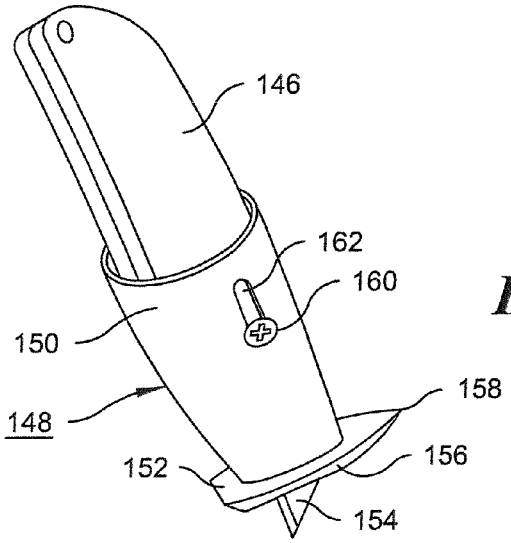
FIG. 18 is an oblique perspective view of a utility knife equipped with a linearly adjustable combination guard and guide in accordance with a seventh embodiment of the invention which is configured for use in cutting flexible flooring material.
Figure 16:
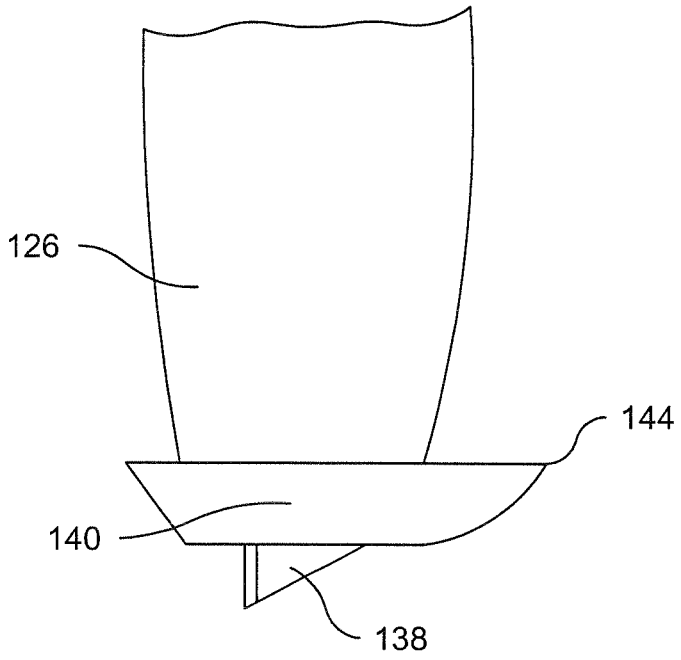
FIG. 16 is a partial side elevational view of the knife of FIGS. 14 and 15.
Figure 17:
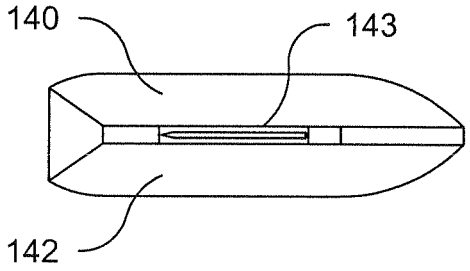
FIG. 17 is a bottom plan view of the guard on the knife of FIGS. 14-16.

FIG. 18 shows a modified version of the flooring cutter of FIGS. 14-17, in which a utility knife 146 is received in a detachable guard 148 comprising a knife handle-receiving part 150 having and a boat-shaped guide 152 having a pair of surfaces each diverging at an angle of 135° from a blade 154, which extends through a slot (not shown) in the guide 152. One such surface is surface 156 in FIG. 16. The guide 152 is similar in shape to the two-part guide of FIGS. 15 and 16, and has a point 158 that can be used as a visual guide.

The detachable guard is secured to the knife handle by a screw 160, which extends through a slot 162. The slot 162 is elongated in the direction of elongation of the knife handle, enabling the cutting depth to be adjusted by adjustment of the extent to which blade 154 protrudes from the guide.

Figure 19:
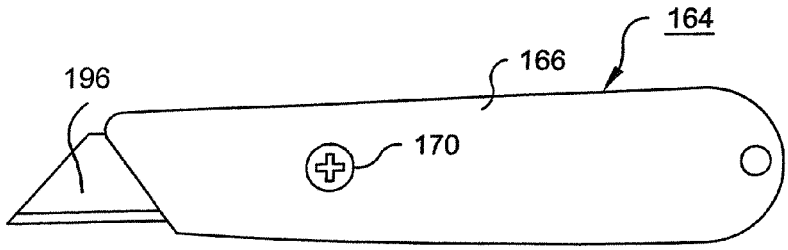
Fig. 19 (Prior Art)
FIGS. 19 and 20 are respectively left and right side elevational views of a conventional utility knife.
Figure 20:
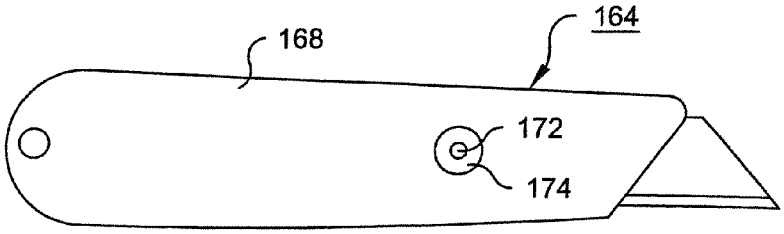
Fig. 20 (Prior Art)
Figure 21:
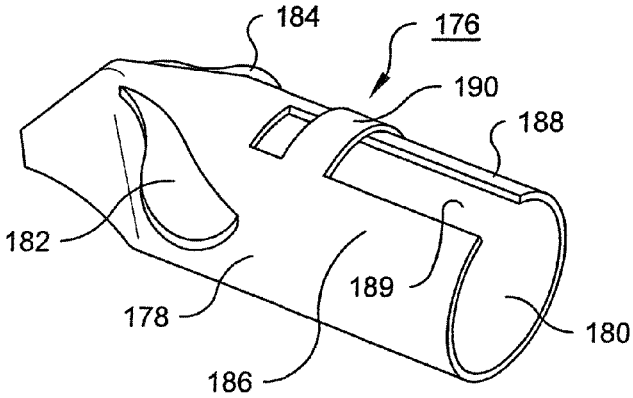
FIG. 21 is a perspective view of a guard in accordance with an eighth embodiment of the invention for attachment to the knife of FIGS. 19 and 20.

FIGS. 19-23 illustrate another embodiment of a guard which can be attached to a utility knife. The knife 164, shown in FIGS. 19 and 20, is a conventional utility knife the handle of which is composed of two longitudinally extending parts 166 and 168, held together by a screw 170. The head of the screw fits into a recess in handle part 166 and the screw is threaded into a threaded hole 172 formed in handle part 168. The threaded hole 172 extends from an inner wall of a recess 174 formed in handle part 168. Most conventional utility knives have the above-described structure, including the recess.

Figure 22:
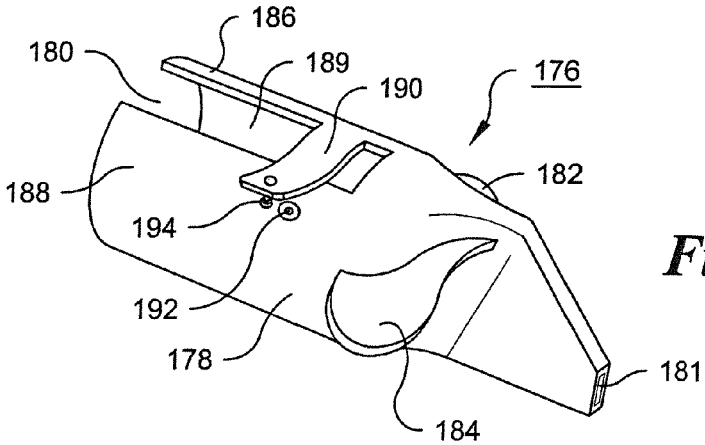
FIG. 22 is another perspective view of the guard of FIG. 21.
Figure 23:
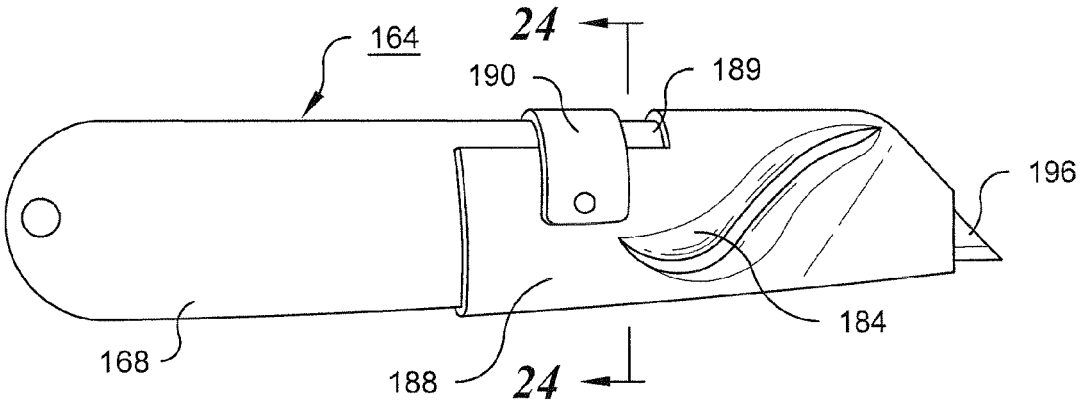
FIG. 23 is a right side elevational view of the knife of FIGS. 19 and 20 with the guard of FIGS. 22 and 23 attached.

The guard 176, shown in FIGS. 22 and 23, comprises a guard body 178, preferably formed from any of a variety of suitable flexible plastic resins such as flexible acetal resins, polyurethane or poly vinyl chloride. The guard has a recess or opening 180 at one end thereof that leads to an interior space for receiving an end of a knife handle from which the knife blade protrudes, and a slot 181 at the other end thereof, through which the knife blade can extend. Two laterally protruding guard members 182 and 184 are molded as a unit with the guard and positioned adjacent the part of the guard body from which the knife blade protrudes. These guard members 182 and 184 are engageable with the thumb and index finger of the user and prevent the thumb and index finger from contacting the knife blade.

The guard body has a first part 186 engageable with one of the opposite sides of a knife handle, and a second part 188 engageable with the other of the opposite sides of the handle. A slot 189 is formed between parts 186 and 188. A flexible strap 190, one end of which is directly and permanently secured to part 186 of the guard body extends across slot 189 from part 186 to part 188. As shown in FIG. 23, part 188 of the guard body includes a socket 192. This socket is in the form of a through hole sized to receive a stud 194 fixed to an end portion of the strap. The stud 194 is of a size such that it fits into the socket with a snap fit, and is sufficiently long that, when it is fitted in the socket 192, it extends through the socket and protrudes therefrom to the inside of recess 174.

Figure 24:
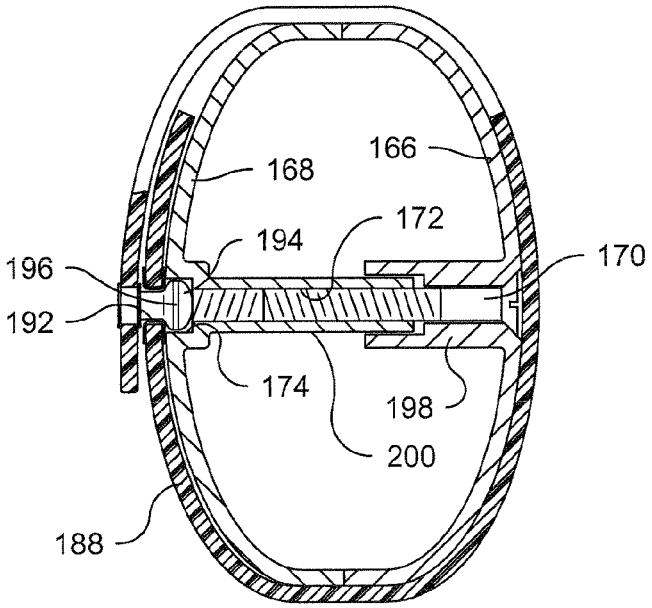
FIG. 24 is a cross-sectional view taken on plane 24-24 of FIG. 23.
Figure 25:
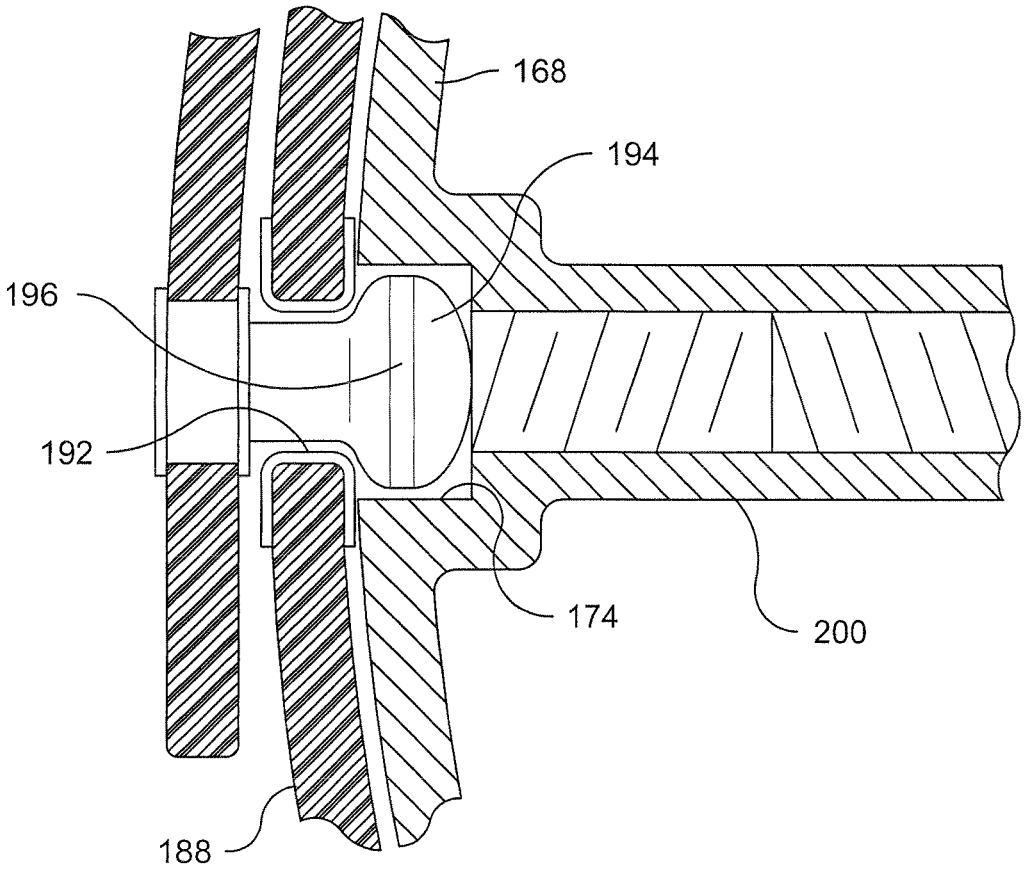
FIG. 25 is an enlarged cross-sectional view showing details of the stud, socket and recess in FIG. 24.

FIG. 23 shows the guard 176 fitted onto the handle of knife 164 so that the part of the handle adjacent the knife blade 196 extends into the interior space in the guard and the tip of the knife blade 196 is exposed through the slot 181 (FIG. 22) in the guard. As shown in FIG. 24, the two parts 166 and 168 of the knife handle are secured to each other by screw 170 which is extends through a boss 198 on part 166 and is threaded into a boss 200 on part 168. The stud 194, which preferably has a enlarged tip, is snap-fit into socket 192 in guard part 188 and extends into recess 174 in knife handle part 168 to limit longitudinal movement of the guard relative to the knife handle. Preferably, the size of the tip of the stud 194 is such that it engages the wall of recess 174 when it is fully inserted into the socket 192 so that it completely prevents longitudinal movement of the guard relative to the knife handle. The enlarged tip of the stud can also have a substantially cylindrical outer surface 196, as shown in FIG. 24, which, when engaged with a similarly shaped cylindrical inner wall of the recess 174, resists longitudinal movement of the guard relative to the knife handle.

Although the guard shown in FIGS. 21-24 is a simple form of guard designed to limit protrusion of the knife blade, the guard of this embodiment can include features such as the doubly tapered plate 80 in FIGS. 5 and 9 for guiding the knife along a straight line, the U-shaped cable guide 118 in FIGS. 11-13, or the boat-shaped corner guide 152 in FIGS. 14-18. These features can be provided either as integral parts of the guard, or can be provided as separate elements attachable to the guard.

What is claimed is:

1. A utility knife comprising:

an elongated handle having first and second opposite sides extending along the direction of elongation of the handle, opposite ends spaced from each other along said direction of elongation, and a recess in said second of said opposite sides;

a blade fixed to and protruding from the handle at one of said opposite ends; and a guard comprising a hollow guard body having an interior space receiving said one of said opposite ends of the handle, a slot through which said blade extends, and a pair of laterally protruding guard members for preventing a user's hand from sliding past said one of said opposite ends of the handle and into contact with the blade, said guard members being positioned adjacent a part of the guard body from which the blade protrudes;

wherein the guard body includes a first part engaged with said first of said opposite sides of the handle, a second part engaged with said second of said opposite sides of the handle, and a flexible strap extending from said first part to said second part;

wherein said strap has first and second opposite ends, the first end of the strap is directly and permanently secured to said first part of the guard body, the second part of the guard body includes a socket, the socket being in the form of a through hole located adjacent, and aligned with, said recess in said second of said opposite sides of the handle, and wherein a stud, secured to said strap adjacent the second of said first and second opposite ends of the strap, fits into said socket with a snap fit and extends through said socket into said recess in said second of said first and second opposite sides of the handle, whereby engagement of the stud in said recess secures the guard against longitudinal movement relative to the handle.

2. A utility knife according to claim 1, wherein a second slot is provided between said first and second parts of the guard body, and wherein said strap spans said second slot.

3. A utility knife according to claim 1, wherein a second slot is provided between said first and second parts of the guard body, wherein said first and second parts of the guard body are flexible and movable relative to each other, and wherein said strap spans said second slot.

4. A utility knife according to claim 1, in which said handle comprises two separable elongated parts, wherein a through hole is provided in said handle, and wherein said separable elongated parts are removably secured to each other by a fastener extending into said through hole, and wherein said recess is a part of said through hole.

* * * * *